United States Patent [19]

Philippe

[11] Patent Number: 5,019,456

[45] Date of Patent: May 28, 1991

[54] ARTICLE WHICH CAN CHANGE ITS SHAPE

[75] Inventor: Jean-Marc Philippe, Paris, France

[73] Assignee: Raychem Corporation, Menlo Park, Calif.

[21] Appl. No.: 236,572

[22] Filed: Aug. 25, 1988

[30] Foreign Application Priority Data

Aug. 25, 1987 [GB] United Kingdom ..... 8720025

[51] Int. Cl.[5] ..... H01H 37/46

[52] U.S. Cl. ..... 428/591; 428/595; 337/140; 337/396

[58] Field of Search ..... 428/960, 616, 591, 595, 428/603; 148/402; 337/140, 139, 393, 395, 396, 397; 60/527

[56] References Cited

U.S. PATENT DOCUMENTS

| | | | |
|---|---|---|---|
| 2,249,582 | 7/1941 | Strobel | 428/616 |
| 3,391,882 | 7/1968 | Johnson et al. | 428/960 |
| 3,497,824 | 2/1970 | Jakobs | 337/140 |
| 3,802,930 | 4/1974 | Brook et al. | 148/11.5 |
| 3,844,756 | 11/1974 | Hickling | 337/140 |
| 4,010,455 | 3/1977 | Stange | 60/527 |
| 4,281,513 | 8/1981 | Johnson et al. | 60/527 |
| 4,691,517 | 9/1987 | Banks | 60/527 |
| 4,808,246 | 2/1989 | Albrecht et al. | 148/402 |

FOREIGN PATENT DOCUMENTS

| | | | |
|---|---|---|---|
| 56-113071 | 9/1981 | Japan | 60/527 |

*Primary Examiner*—John J. Zimmerman
*Attorney, Agent, or Firm*—Herbert G. Burkard

[57] ABSTRACT

An article comprises a bent strip 2, the ends (4) of which can be rotated relative to each other to cause the strip to change its shape. One embodiment of the strip is initially in the shape of a split circle. Rotation causes the strip to adopt an intermediate complex shape and then a double circle shape. One application of the invention is as a statue.

8 Claims, 4 Drawing Sheets

ARTICLE WHICH CAN CHANGE ITS SHAPE

DESCRIPTION

The present invention relates to an article, parts of which can be moved relative to each other to change the shape of the article.

In particular preferred embodiments of the invention relate to articles in which the relative movement between the parts of the article is effected by an actuator which is activated by temperature.

Temperature activated actuators are well know. One example is a bimetal strip which comprises two metals having different coefficients of expansion arranged so that the strip curls or uncurls in response to a temperature change. Such a strip may be used for example as a temperature controlling switch in a heating device. Another known example of an article which can change its shape in response to a temperature change is a suitable heated shape memory alloy. Typically, an article made of such materials can be deformed from an original, heat-stable configuration to a second, heat-unstable configuration. The article is said to have shape memory for the reason that, upon the application of heat alone, it can be caused to revert, or to attempt to revert, from its heat-unstable configuration to its original, heat-stable configuration, i.e. it "remembers" its original shape.

Among metallic alloys, the ability to possess shape memory is generally a result of the fact that the alloy undergoes a reversible transformation from an austenitic state to a martensitic state with a change in temperature. This transformation is sometimes referred to as a thermoelastic martensitic transformation. An article made from such an alloy, for example a hollow sleeve or a strip, is easily deformed from its original configuration to a new configuration when cooled below the temperature at which the alloy is transformed from the austenitic state to the martensitic state.

The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete) the deformed object will begin to return to its original configuration.

Shape memory alloys (SMAs) have found use in recent years, for example as pipe couplings (such as are described in U.S. Pat. Nos. 4,035,007 and 4,198,081 to Harrison and Jervis), as electrical connectors (such as are described in U.S. Pat. No. 3,740,839 to Otte & Fischer), as switches (such as are described in U.S. Pat. No. 4,204,293), and as actuators, etc.

Shape memory metal alloys may exhibit a one-way nonreversible shape change, or a two-way reversible shape change. Alloys which exhibit a so-called one way effect change their shape when the temperature is raised and the material transforms to the austenitic phase, but do not recover to their original heat-unstable deformed shape when they are once again cooled below the transition temperature. Alloys which exhibit a two-way effect exhibit a purely thermally dependent shape reversibility upon thermal cycling. Alloys which exhibit a one way effect are known and used, for example, for couplings where shape reversal would disadvantageously result in the coupling becoming loose. Alloys which exhibit a two-way effect are known and used for example as thermoelastic switches, for example as described in U.S. Pat. No. 4,205,293.

It is also known to use one-way effect memory metal alloys in applications where reversibility is required. This may be done by using an auxiliary biasing means, for example a spring member, in conjunction with the memory metal, the spring acting to revert the metal alloy to its previously deformed heat-unstable configuration on cooling subsequent to recovery.

Another memory metal alloy is one which exhibits a shape memory effect as a result of the alloy undergoing a reversible transformation between austenite and the R phase. Such an alloy exhibits a hysteresis free 2-way effect (called ARSME).

Shape memory alloys employing the martensite-austenite change and shape memory alloys employing the ARSME change are both useful in the present invention.

One specific example of a memory metal alloy used as an actuator is described in GB 1578741. This describes a valve actuating safety device that acts to close or open a valve under excessive temperature conditions. The device comprises a memory metal alloy coiled spring which winds or unwinds on recovery to close or open the valve.

We have discovered a new design of article parts of which can be moved by an actuating means to cause the article to change its shape.

Thus the present invention provides an article comprising a strip of material and one or more actuating means capable of moving spaced apart points of the strip relative to each other to cause the strip to adopt different configurations during the relative movement.

Preferably the actuating means rotates the spaced apart points of the strip relative to each other.

The actuating means is preferably temperature dependent, but may be non-temperature dependent, for example an electrically powered motor. Preferably, however, the actuating means is temperature dependant, for example comprising a bimetal strip or shape memory alloy. For some applications the invention is advantageous where the actuator can cause such shape changes as a result of day/night or seasonal temperature fluctuations. For other applications, for example where the shape change is to be used for industrial use, e.g. in a switch or temperature dependant filter the actuator preferably causes shape changes over a variety of temperature fluctuations. The invention finds application, for example, as an industrial device, for example a switch or filter, or as a statue or a toy.

Preferably the spaced apart points of the strip which are moved relative to each other by the actuator are the ends of the strip.

Preferably the position of the spaced apart points of the strip and the modulus of the strip are such that the strip curves or bows between spaced apart points.

Also, the spaced apart points of the strip are preferably secured at a fixed distance relative to each other, but in such a manner to allow their relative movement.

The actuating means may be arranged to move, for example rotate the spaced apart points (preferably the ends) of the strip in any direction. The actuator may be arranged to move the spaced apart points of the strip relative to each other in a single or in parallel planes. The actuator may be arranged to rotate the spaced points about the axis of the strip at each point, i.e. so that the direction of rotation is in a plane perpendicular to the axis of the strip at each point. In an alternative example, the actuator may be arranged to rotate the spaced apart point of the strip in a plane tangential to the axis of the strip at each point. As the spaced apart points move relative to each other the remainder of the strip also starts to move and it is this which causes the shape change to the strip. Depending on the initial position of the strip and the direction of movement caused by the actuator the resultant shape changes of the strip will be different. Some specific embodiments are now described.

In one preferred embodiment spaced apart points, for example the ends, of the strip are secured so that they overlap and so that, before recovery, the strip bows for example in a generally circular or oval shape between the overlapped points. With this arrangement the actuator may be arranged, to rotate the spaced points ends of the strip relative to each other about a pivot point passing through the overlapped points in a plane tangential to the strip axis at the pivot point. With such an arrangement relative rotation of the spaced apart points of the strip by 360° causes the strip to transform its shape from a single bow (for example circle) to a spiral of two bows between those points. In particular embodiments the actuator, is temperature dependant, and is preferably arranged to cause a 360° relative rotation during temperature fluctuations. In some embodiments the actuator is arranged to cause such 360° rotation during temperature fluctuations typical of night/day or seasonal changes. In the above described embodiments, for a temperature dependant actuator the single bowed shape may be the shape of the strip at a low temperature which is transformed to the double bowed shape when the temperature rises. In an alternative arrangement, the article may be arranged to transform the strip from a double to a single bowed shape on increasing the temperature. Transformation from a single to double bow involves rotation in the opposite sense from that to transform from a double to a single bow.

In another similar embodiment spaced apart points, for example the ends, of the strip are again secured so that they overlap and can rotate about a pivot point passing through the overlapped points in a plane tangential to the strip at the pivot point. In this case however the original coiling of the strip and the direction of rotation caused by the actuator are such that a 360° rotation results in a transformation from a spiral shape of two coiled bows to one of three coiled bows or vice versa.

As a general principle, for arrangements in which spaced apart point of the strip are secured so that they overlap and can rotate about a pivot point passing through the overlapped points in a plane tangential to the strip axis at the pivot point, the actuator is preferably arranged to cause a large angular relative rotation, e.g. between 180° and 360°, in particular about a 360° relative rotation of the spaced apart points of the strip causing a change from a spiral of N bows (e.g. circles) to N +1 bows/ (e.g. circles) or vice versa (where N is any integer greater than or equal to 1).

Similar embodiments to those described above are those in which the spaced apart points, for example the ends of the strip approach each other but do not overlap. In this case, depending on the separation of the spaced apart points, and the length of the strip, the strip will again adopt a bowed circular or generally oval path, between the said points. Once again in preferred embodiments one or more actuators may be used to cause relative movement, for example rotation, of the spaced points of the strip in a plane tangential to the strip at each point. As before the actuator is preferably temperature dependant, and in some embodiments is arranged to cause a 360° relative rotation during temperature fluctuations. In particular embodiments the actuator is arranged to cause such 360° rotation during temperature fluctuations typical of night/day or seasonal changes. The rotation may be achieved using a single actuator at one point on the strip or two actuators, one at each spaced apart point of the strip. Where two actuators are used each of which may, for example, cause a 180° rotation in a sense such that the total relative rotation on recovery is 360°.

In other preferred embodiments according to the invention the actuator is preferably arranged to cause rotation of the strip about the axis of the strip, i.e. in a plane perpendicular to the axis of the strip. In one such embodiment spaced apart points of the strips are brought adjacent each other, for example the ends are brought into abutment, so that before recovery the strip forms a generally bowed (for example circular) shape between those points. Once again, the actuator is preferably arranged to provide a 360° relative rotation. This again results in a recovered shape comprising a spiral of two bows (circles), but the intervening shape is different from that caused by rotation in a plane tangential to the strip.

Similarly the strip can be arranged so that it transforms from a two-bowed shape to a single bowed shape recovery or from a bow of N to N ±1 turns on rotation.

Also the spaced apart points (for example the ends) of the strip can initially be separate from each other and an actuator provided on one or both ends.

Where two or more actuators are used they may be the same or different. For example none, one or both/several may be temperature dependent. Also where two actuators comprise memory metal the properties may be the same or different, they may comprise the same or different alloys, transform at the same or different temperature and rate, and have the same or different configuration. Also the actuators may cause the relative movement in the same or different sense.

The preferred actuator(s) for use in the present invention is a memory metal actuator. The memory metal is preferably predeformed so that on heating about its transition temperature it transforms to austenite and recovers to, or towards its undeformed shape. This recovery and shape change, is arranged to cause the relative rotation of the spaced apart points on the strip, and in the preferred embodiments described above, to cause a 180° or 360° relative rotation.

Preferably the actuator comprises a memory metal which exhibits a two-way effect, or a memory metal which exhibits a one-way effect in combination with a mechanical biasing means. This means that the relative rotation caused by recovery of the memory metal on heating to a temperature above the transformation temperature is reversed when the temperature is reduced again. Thus the shape change is reversible during temperature fluctuations.

The memory metal actuator may recover, and hence cause the relative movement of the strip ends slowly over a temperature range, or substantially instantaneously at a specific temperature. Where recovery is over a temperature range, a small change in the ambient temperature will result in a shape change of the strip over a wide range of temperatures. Where the actuator recovers instantaneously at a specific temperature a shape change in the strip will be seen substantially at that temperature. For many applications the memory metal preferably exhibits zero or little hysteresis on transformation of the alloy from its austenitic to martensitic state. Where hysteresis is involved reversal of the state of an SMA element may require a temperature excursion of several tens of degrees Celsius.

Examples of suitable memory metals that can be used include nickel/titanium alloys. A particularly preferred alloy is nickel/titanium alloy also comprising copper as described in European Patent 0088604 (MP0813), the disclosure of which is incorporated herein by reference.

Other suitable memory metal alloys are those exhibiting the so called ARSME shape memory change, described above.

One example of a suitable actuator comprises a composite structure comprising a memory metal which exhibits a one-way effect in combination with an auxiliary mechanical member. In one embodiment the actuator comprises a spiral double layer strip, the outer layer being a spring metal and the inner layer a memory metal. When heated above its transition temperature the memory metal transforms to austenite and recovery occurs. Assuming the memory metal strip has previously been deformed from a straight shape this causes the spiral to tend to uncurl. The composite strip is arranged so that when the memory metal is in its austenitic state the recovery forces of the memory metal are greater than the spring forces of the spring metal. Conversely when the temperature is cooled again the memory metal transforms to martensite which is weaker than austenite. In this case the spring forces cause the spiral to recoil. Opposite ends of the spiral can be attached to each of the said spaced apart points of the strip to cause their relative movement.

In other embodiments a straight, or any other shaped composite strip could be used, curling to a partial circle, spiral or any other shape in which the actuator could be connected to spaced apart points on the strip to cause relative movement of those points.

The strip of material actuated by the actuator may be any suitable shape and may comprise any suitable material. Preferably it has an appropriate bend modulus such that it maintains a bowed or curved shape between the said spaced apart points. For this it must be sufficiently compliant that it can be curved but not so compliant that it cannot maintain its curved shape under the action of gravity. These features depend inter alia on the modulus of the strip. The modulus of the strip depends on the modulus of its material and also on the cross-sectional shape of the strip. A preferred shape of the strip is a flat band having a width significantly greater than its thickness, preferably at least ten times greater than its thickness. Other shapes include rod-shaped strips of circular cross-section, tubes and the like. Another preferred shape is a flat band having a portion of significantly greater thickness towards its center. For example the flat band may be generally T-shaped in cross section, with a short stem to the "T", which short stem of the "T" represents the thickened portion. This shape helps to prevent sagging due to gravity.

The bend modulus of material must also be appropriate such that the strip can rotate and twist when the spaced apart points of the strip are moved relative to each other under the action of the actuator.

In particularly preferred embodiments the strip itself comprises a memory metal. Where the actuator is temperature dependent, the strip preferably recovers in the same or similar temperature range to that of activation of the actuator. Preferably the memory metal exhibits a two-way effect or exhibits a one-way effect in association with mechanical means to effect a reversible shape change. This means the shape change of the strip caused by movement of the spaced apart points of the strip is augmented by a shape change in the strip itself. Preferably only part of the length of memory metal strip has been deformed and hence changes shape on recovery, or part only is preferentially deformed. The provision of a curved memory metal strip which has been only partly or preferentially deformed is believed novel per se.

Hence a second aspect of the present invention provides a curved memory metal strip, part only of which has been deformed, or part only of which has been preferentially deformed, to render it recoverable, which can be heated to cause it to recover to revert to its undeformed state.

In a preferred embodiment according to this second aspect of the invention the strip forms a closed loop, preferably a closed loop with one twist in it. Preferred features for the strip according to the first aspect of the invention are also preferred for the strip according to the second aspect of the invention. In particular, the strip is preferably in the shape of a flat band, or one having a T-shaped cross-section as described above.

In another embodiment, the strip itself does not comprise memory metal but is acted on by a bowed memory metal strip with ends fixed at spaced apart points on the memory metal. The action of such a bowed memory metal strip is also believed to be novel per se.

Thus a third aspect of the invention comprises a first strip of material and a second strip of material which comprises a memory metal, the ends of which are secured to spaced apart points on the first strip of material, wherein recovery of the memory metal strip causes the shape of the first strip of material between the two said points to change.

The invention also provides an article comprising a combination of two or more of the articles according to the first, second and third aspect of the invention.

Embodiments of the invention will now be described, by way of example, with reference to the accompanying drawings and photographs, wherein:

FIGS. 1*a* to 1*c* are photographs of sequential stages of rotation of one article of the invention.

FIG. 2 is a photograph and FIG. 3 is a schematic representation of other articles according to the inventions.

FIG. 4*a* to 4*c* are photographs and FIGS. 5*a* to 5*b* are schematic representations of sequential stages of rotation of other articles according to the invention.

Figure 1A:
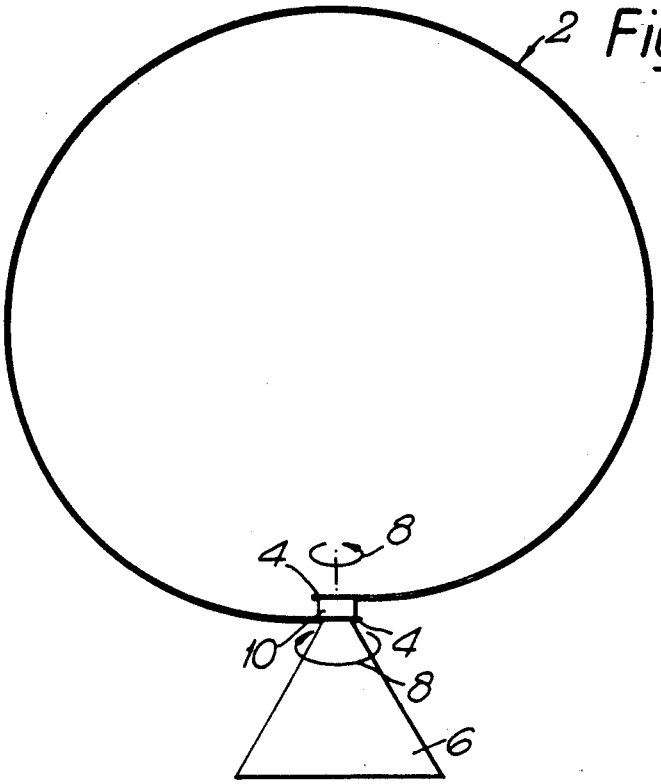
Figure 1B:
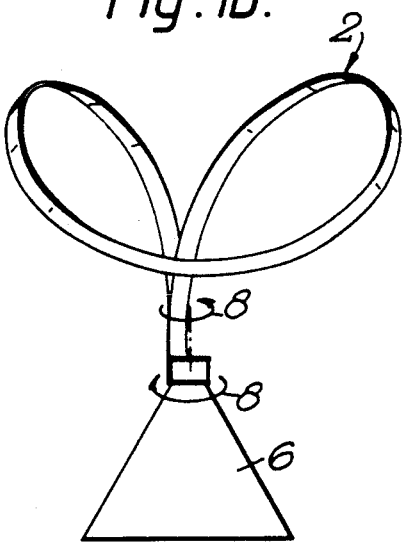
Figure 1C:
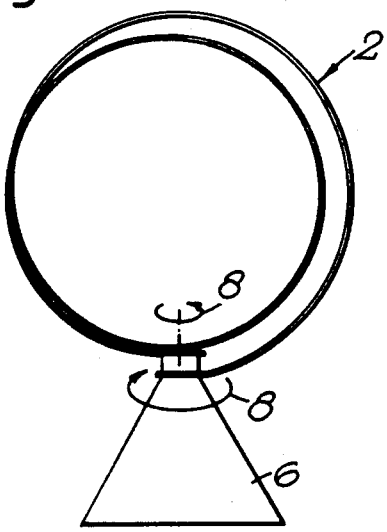

Referring to the drawings and photographs, FIG. 1*a* shows an article according to the invention comprising a stainless steel strip 2 bowed into a circle with overlapping ends 4 containing holes (not shown) so it can be mounted on a pivot 6. The ends 4 are thus free to rotate relative to each other in the plane tangential to the circle at the pivot point 6 as indicated by arrows 8. The modulus of strip 2 is such that it adopts a generally circular configuration, (or an oval configuration under the effect of gravity). A memory metal actuator 10 is connected to each end 4 of the strip 2 and can rotate those ends. In FIG. 1*a* the actuator 10 is in its low temperature martensitic state. As the temperature is raised the actuator transforms to austenite and undergoes a shape change. This change is arranged to cause rotation of the strip ends 4, in the plane tangential to the strip axis, in the direction indicated by arrows 8. As the ends rotate it causes the strip 2 itself to change shape. FIGS. 1*b* and 1*c* show sequential stages in the rotation. FIG. 1*b* represents a relative rotation between the ends 4 of 180° and FIG. 1*c* represents a relative rotation of 360°. It can be seen that a rotation of 360° causes the shape to transform from a single circle to a spiral of two turns.

Figure 2:
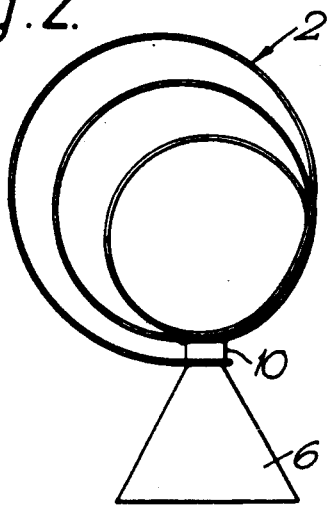

FIG. 2 shows a similar article in which the strip 2 is in the form of a spiral of three turns. This article results if the ends 4 of the strip 2 in FIG. 1*c* are relatively rotated a further 360°. Thus, for example an article could be made in the shape of FIG. 1*c* with the actuator 10 in its low temperature state, and then transformed to an article of the shape of FIG. 2 by relative rotation of the strip ends of 360°.

Figure 3:
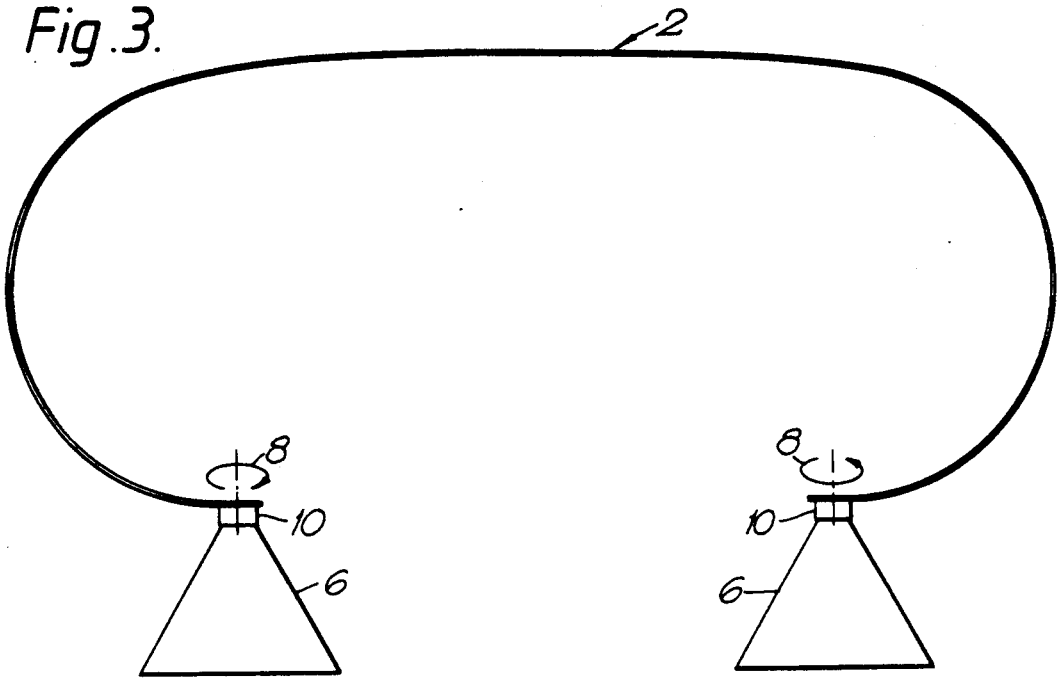

FIG. 3 shows an article similar to FIG. 1*a* except that ends 4 are spaced from each other. Each end 4 is provided on a pivot 6 and provided with a memory metal actuator 10. The actuators are arranged to provide rotation in opposite senses so that the resultant relative rotation is additive. Again rotation is in the plane tangential to the strip axis at its end 4. If each actuator provides a rotation of 180° on recovery the total relative rotation between the ends is 360° resulting in the shape of FIG. 1*c*.

Figure 4A:
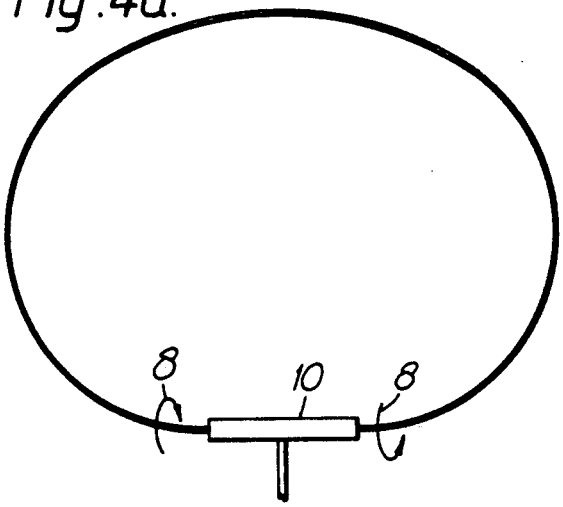
Figure 4B:
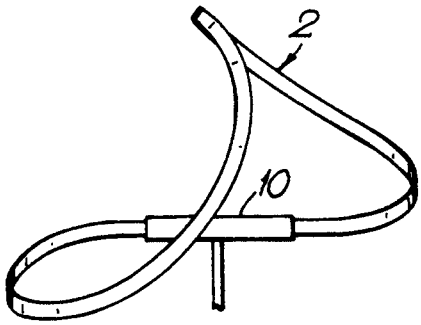
Figure 4C:
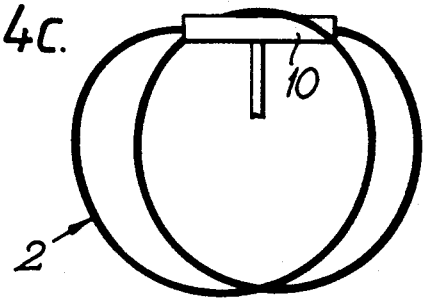

FIG. 4*a* shows an article similar to FIG. 1*a* except that ends 4 abut but do not overlap and the actuator is arranged to provide rotation about the axis of strip end 4, as indicated by arrows 8. FIGS. 4*b* and 4*c* show the strip after relative rotation of the ends by 180° and 360° respectively. It will be seen that the final shape caused by 360° rotation is the same as for the embodiment of FIG. 1, but that the intermediate shape is different.

Figure 5A:
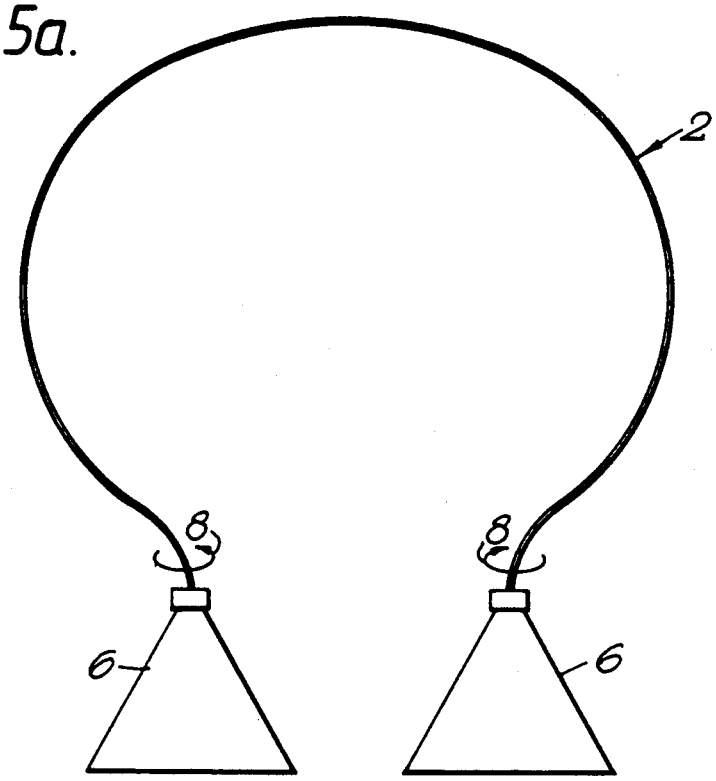
Figure 5B:
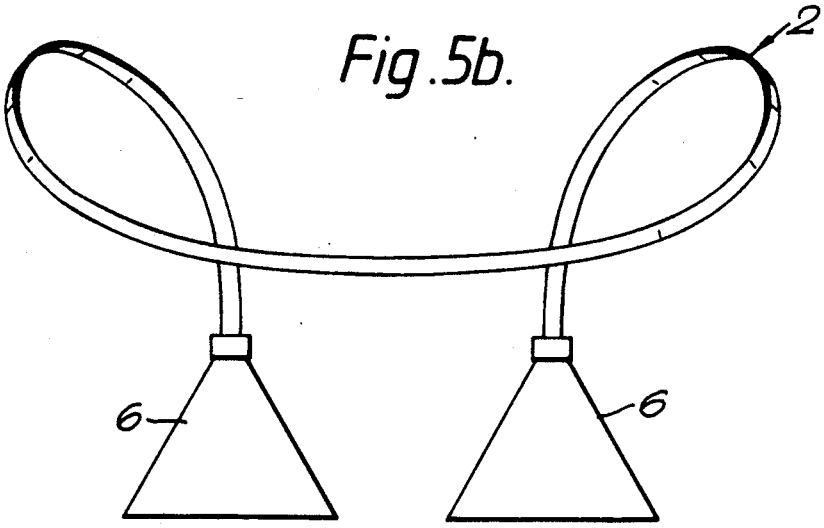

FIGS. 5*a* and 5*b* show an article similar to FIGS. 4*a* and 4*c* in which rotation is about the axis of strip end 4, but in which the ends 4 are initially spaced apart. FIG. 5*b* shows the result of each end 4 rotated 180° in an opposite sense.

In each of the embodiments shown above the rotation can be reversed, on cooling, if the memory metal actuator comprises a memory metal which exhibits a two-way effect, or if it comprises a composite structure in which the memory metal actuator exhibits a one-way effect, and an auxiliary mechanical member is used to reverse the rotation.

Figure 6:
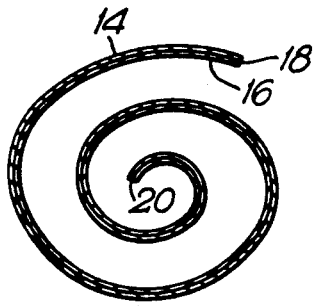
FIG. 6 is a plan view of an actuation according to the invention.

FIG. 6 shows an example of a composite structure actuator that can be used. It comprises a spiral of a double layer strip. The outer layer 14 is spring steel and the inner layer 16 a nickel-titanium memory metal exhibiting a one way effect. The actuator is shown in FIG. 6 in its cold position, i.e. when the memory metal is in its martensitic state. When heated above its transformation temperature the memory metal transforms to austenite and recovery occurs. The memory metal strip 16 has previously been deformed from a straight shape, and hence on recovery attempts to recover to this original undeformed state. This causes the spiral to tend to uncurl. Hence outer end 18 of the spiralled composite strip 14/16 tends to rotate anticlockwise, and the inner end 20 of the spiralled composite strip tends to rotate clockwise. The composite strip is arranged so that when the memory metal is in its austenitic state the recovery forces are greater than the spring forces of the stainless steel strip 14, so that uncurling occurs. Conversely when the temperature is cooled again, the memory metal strip 16 transforms to martensite which is weaker than austenite. In this case the spring force of steel strip 14 causes the spiral actuator to curl tightly again, i.e. the rotation of ends 18 and 20 of the spiral are reversed.

Where the actuator of FIG. 6 is to be used to connect both ends 4 of the strip 2, ends 18 and 20 of the actuator are connected to opposite ends 4 of the strip 2 to cause their relative rotation. Where separate actuators are to be eased for each end 4 of the strip 2 one end 18 or 20 is fixed to the strip end 4, and the other end 20 or 18 to a fixed point.

Figure 7:
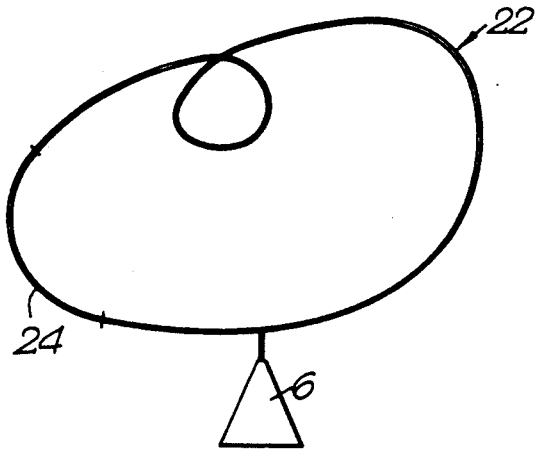
FIGS. 7 and 8 are schematic representations of other articles according to the invention.

FIG. 7 shows another embodiment according to the invention in which the memory metal strip 22 itself comprises a memory metal. Part only 24 of the strip has been deformed to render it recoverable, or has been preferentially deformed. The result is that on transformation the strip 22 changes its shape. Thus arrangement can be used in combination with rotatable end parts of the strip, or not.

Figure 8:
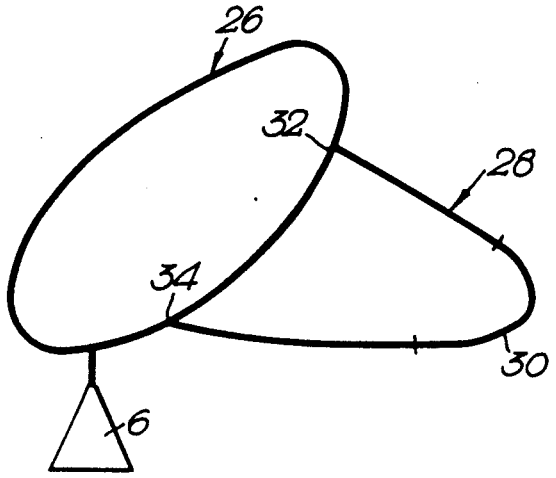

FIG. 8 shows another embodiment in which an auxiliary curved memory member strip 28, preferentially deformed at section 30 acting on a non recoverable coiled strip 26. Strip 28 is connected to spaced apart points 32, 34 on strip 26, so when strip 28 recovers it also causes strip 26, so when strip 28 recovers it also causes strip 26 to change shape. This arrangement can be used with rotatable end parts on the strip 26 or not.

I claim:

1. An article comprising a strip of material and at least one actuator capable of moving spaced apart points of the strip relative to each other wherein the actuator is arranged to move the spaced apart points of the strip relative to each other in single or parallel planes.

2. An article according to claim 1, wherein before or after relative movement of the spaced apart points the strip is positioned so that the spaced apart points of the strips overlap so that the strip adopts a generally circular shape between those points.

3. An article according to claim 2, wherein the strip is positioned so that before or after actuation the strip is positioned so that it adopts a configuration of a spiral of two or more bows between its ends.

4. An article according to claim 2, wherein actuation of the actuator causes a relative rotation between the spaced apart points of the strip of 360° which results in the shape of the strip changing from a single bow or spiral of N bows to a spiral of $N+1$ or $N-1$ turns.

5. An article according to claim 1, wherein the actuator comprises a memory metal and wherein the strip itself also comprises a memory metal at least part of which has been deformed so that it exhibits a shape change at the temperature required to effect recovery of the actuator memory metal.

6. An article according to claim 1, comprising a second strip comprising a memory metal, the ends of which second trip are secured at spaced apart points on the first strip, wherein the second strip has been deformed so that it exhibits a shape change, and consequently effects a shape change in the first strip at the temperature required to effect recovery of the actuator memory metal.

7. An article comprising a strip of material and at least one actuator capable of moving the spaced apart ends of the strip relative to each other in a plane perpendicular to the axis of the strip.

8. An article comprising a strip of material and at least one actuator capable of moving the spaced apart ends of the strip relative to each other in a plane tangential to the axis of the strip at each point.

* * * * *